United States Patent [19]

Kubick

[11] 3,993,168

[45] Nov. 23, 1976

[54] PALLET

[75] Inventor: Mark Kubick, Baden, Pa.

[73] Assignee: Pallet Development Inc., Ambridge, Pa.

[22] Filed: Mar. 7, 1974

[21] Appl. No.: 449,099

[52] U.S. Cl. ..... 108/53.1; 108/55.3

[51] Int. Cl.[2] ..... B65D 19/32; B65D 19/44

[58] Field of Search ..... 108/58, 51, 55, 57, 108/53, 53.1, 55.3

[56] References Cited

UNITED STATES PATENTS

| | | | |
|---|---|---|---|
| 2,444,326 | 6/1948 | Baker et al. | 108/55 |
| 2,584,762 | 2/1952 | Vossenberg | 108/57 |
| 3,467,032 | 9/1969 | Rowlands et al. | 108/58 |
| 3,630,157 | 12/1971 | Ortenblad | 108/58 |
| 3,667,403 | 6/1972 | Angelbeck, Jr. | 108/58 |
| 3,702,100 | 11/1972 | Wharton | 108/58 |
| 3,707,127 | 12/1972 | Palfey | 108/58 |
| 3,709,162 | 1/1973 | Roper | 108/51 |
| 3,750,596 | 8/1973 | Box | 108/53 |
| 3,795,206 | 3/1974 | Utz | 108/51 |

FOREIGN PATENTS OR APPLICATIONS

| | | | |
|---|---|---|---|
| 1,268,059 | 5/1968 | Germany | 108/51 |

*Primary Examiner*—Roy D. Frazier
*Assistant Examiner*—Darrell Marquette
*Attorney, Agent, or Firm*—Howard E. Sandler

[57] ABSTRACT

A pallet and more particularly a pallet formed of resinlike material having: a unitary working surface configuration to captively carry selected ones of a plurality of varying diameter annular members thereon; unitary peripheral vertical walls and intermediate vertical walls arranged to transfer load directly between the spaced working walls at areas of maximum load concentration; and unitary struts extending transversely between adjacent vertical walls to inhibit transverse deflection of the pallet.

3 Claims, 10 Drawing Figures

PALLET

Pallets are generally constructed of metal, wood or cardboard materials and the present trend has been towards resin materials in view of: the poor strength characteristics of cardboard, the expense of wood and metal, the heavy weight and tendency of metals to oxidize; the absorptiveness of wood, and the potential unsafe condition of wood because of the possibility of wood pallets coming apart and/or being knocked out of square. The resin or plastic pallets molded heretofore have proved to be satisfactory; however, problems develop in particular application situations because of the low coefficient of friction and also the particular modulus of elasticity of the resin material used therein.

Some of the plastic pallets utilized heretofore are adapted to be lifted and moved by tines of a fork lift truck or the like. During such movement or subsequent movement on a conveyor, lateral forces may occur or the pallet may be carried at an angle greater or less than horizontal thereby creating a tendency for the load to move or slide on the pallet supporting surface. Because of the low coefficient of friction between the pallet supporting surface actual sliding between the pallet and the load may occur unless extreme caution is taken. Furthermore, if the articles being carried by the pallet are of any substantial height a potential tipping problem is present.

By means of the present invention which includes a unitary working surface configuration to captively receive selected ones of a plurality of members thereon and with the upper end of such members being captively received by the opposite working surface of another pallet the hereinabove mentioned problems of sliding and tilting is alleviated.

Other problems which existed with some of the plastic pallets utilized heretofore resides in the fact that where such pallets are utilized to support heavy loads thereon intermediate the outer periphery thereof intermediate openings with unitary webs were provided for direct transfer of the loads from the top to the bottom surface without excess vertical deflection of the top surface. Such an arrangement of internal vertical openings has proved satisfactory, however, in instances of severe loading a tendency of transverse defletion of the vertical webs would occur. Accordingly, the present invention additionally includes integrally formed reinforcing means or struts extending transversely across the opening intermediate adjacent webs. Such reinforcing struts stiffen the webs adequately to prevent the transverse deflection thereof.

A still further feature of the present invention is the provision that the periphery thereof extends inwardly along certain portions thereof to provide for a more direct and efficient transfer of loads from the upper surface thereof.

A still further feature of the present invention resides in the fact that the bottom surface of the pallet is provided with a surface configuration conforming to the upper periphery of the work being supported. Accordingly, articles such as frusto conical or flanged rims may be interlocked by captively carrying the upper and lower peripheral portions thereof by a pair of vertically spaced pallets with the rims being disposed therebetween.

These and other objects and advantages of the present invention will become more readily apparent upon a reading of the following description and drawings in which.

Figure 1:
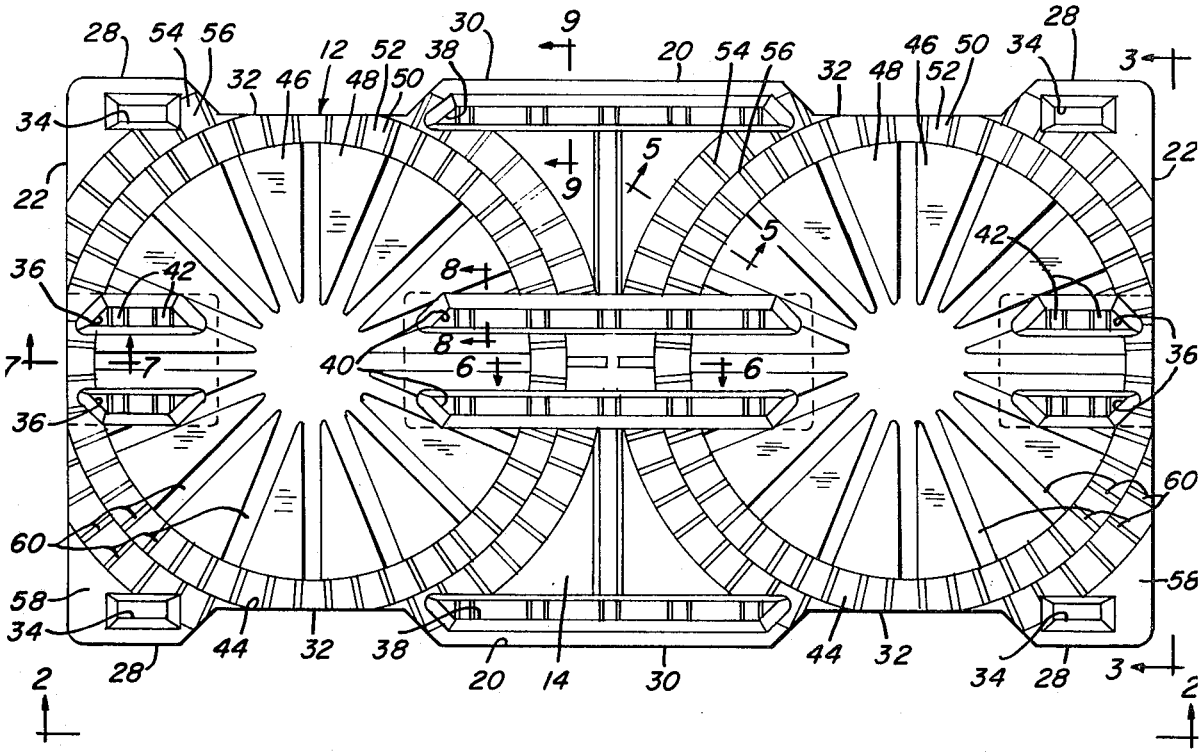
FIG. 1 is a top plan view of a pallet constructed in accordance with the principles of the present invention.
Figure 2:
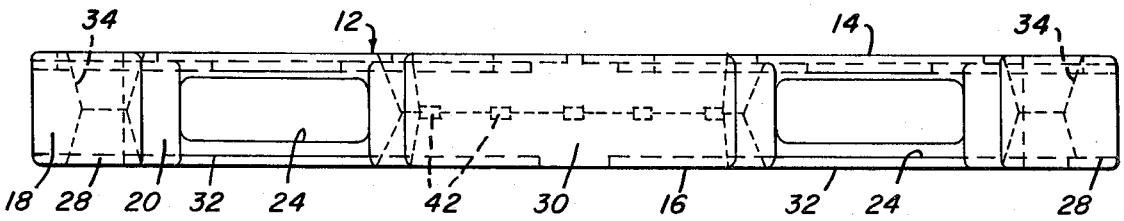
FIG. 2 is a side elevational view taken on lines 2—2 of FIG. 1.
Figure 3:
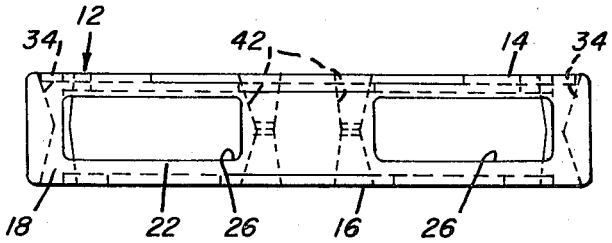
FIG. 3 is an end elevational view taken on lines 3—3 of FIG. 1.
Figure 4:
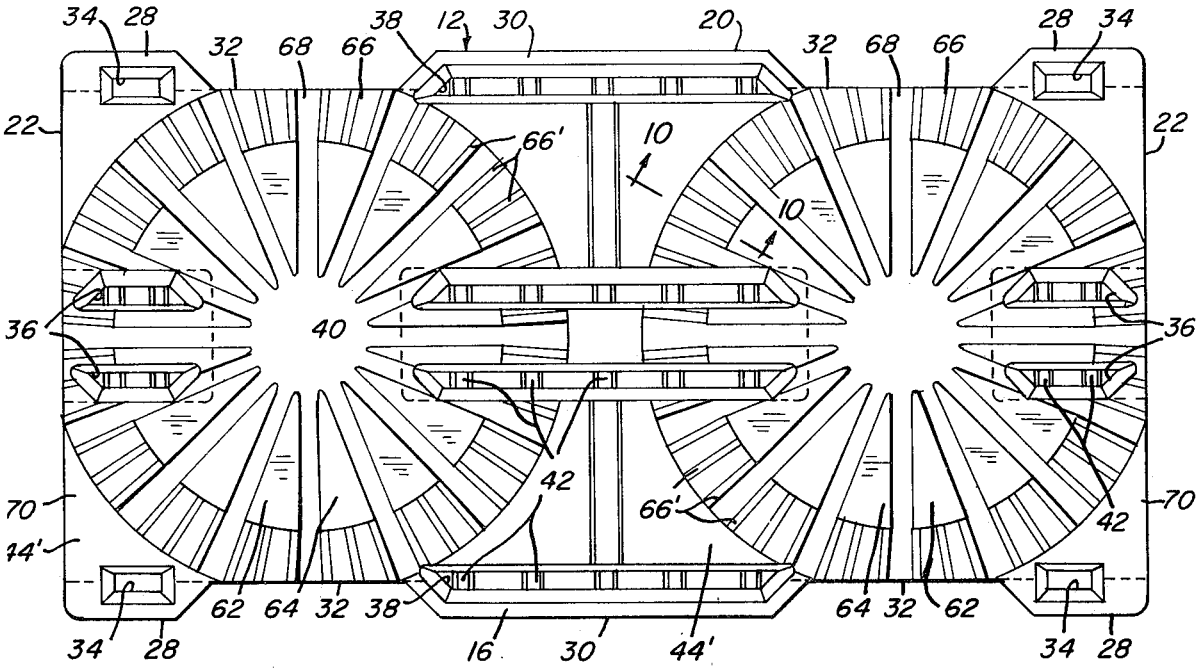
FIG. 4 is a bottom plan view of the pallet illustrated in FIG. 1.
Figure 5:
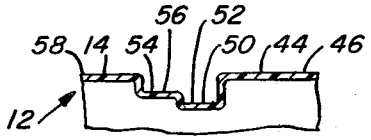
FIGS. 5 through 10 are partial cross sectional views of the pallet constructed according to the principles of the present invention taken on the corresponding lines of FIGS. 1 – 4.
Figure 6:
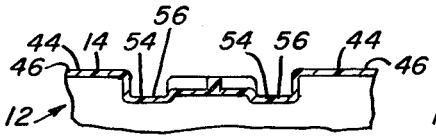
Figure 7:
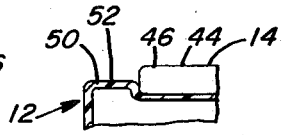
Figure 8:
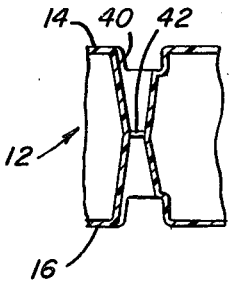
Figure 9:
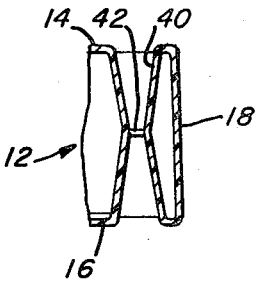
Figure 10:
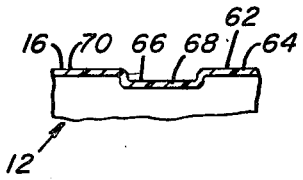

FIGS. 1–10 illustrate a generally rectangular pallet, generally indicated at 12, constructed in accordance with the principles of the present invention and formed as a unitary structure of resinlike material by a rotational molding process in a suitable manner. Pallet 12 comprises upper and lower spaced walls 14 and 16, respectively which are joined together by a unitary sidewall 18 which extends substantially vertically therebetween adjacent the extreme outer peripheries of walls 14 and 16. Sidewall 18 includes a pair of transversely spaced side portions 20 which as shown extend along the long side of pallet 12 and a pair of axially spaced end portions 22 which as shown extend along the short side of pallet 12. Each portion 20 and 22 include a pair of tine receiving openings 24 and 26, respectively, therewithin with the openings 24 along one side portion 20 transversely aligned with the tine receiving openings 24 along the other side portion 20 and with the openings 26 along one end portion 22 axially aligned with the openings 26 along the other end portion 22. Accordingly, with the arrangement of tine receiving openings and the fact that pallet 12 is hollow with the exception of certain web members as described hereinafter, an arrangement is apparent for tines such as the tines of a well known fork lift truck to pass through pallet 12 from both the axial and transverse directions. Thus the pallet as shown herein is of the "four way entry" type.

Each side portion 20 of sidewall 18 includes: axially spaced end portions 28 and an intermediate portion 30 with the outer periphery of portions 28 and 30 lying in a common plane; and direct load bearing support portions 32 extending longitudinally intermediate portions 28 and 30 and transversely intermediate therefrom in the vicinity of respective tine openings 24. As will be fully described hereinafter portions 32 aid in a more positive and direct transfer of loads between walls 14 and 16 by being directly positioned in the vicinity of loading to walls.

To aid in the direct transfer of intermediate loading from the upper wall 14 to the lower wall 16 a plurality of interior continuously walled openings are provided which are integrally formed with walls 14 and 16 and extend therebetween. As shown such walled openings include: walled openings 34 one of which is formed adjacent each corner of pallet 12; walled openings 36 a pair being formed adjacent each axial end of pallet 12 intermediate a respective transversely spaced pair of openings 34; walled openings 38 one of which is formed inwardly adjacent intermediate portion 30 of each side wall portion 18 and having an axial extent thereof substantially equal to the axial extent of portion 30; and an adjacent pair of walled openings 40 having a configuration and axial extent similar to openings 38 and being positioned transversely intermediate the spaced openings 38. As illustrated, openings 34–40 all have a generally rectangular periphery and extend longitudinally in the longitudinal direction of pallet 12.

To further facilitate the load transfer capabilities of walled openings 34–40 as well as to prevent excessive deflection thereof and of the upper or lower walls 14 and 16, respectively, the invention herein provides for a plurality of stiffening struts 42 which as shown are integrally formed with the walled openings 34–40 and extend transversely between the longitudinal walls thereof intermediate the upper and lower ends of such walls. With the provisions of the stiffening struts 42 any tendency of the upper walls or webs to deflect or deform outwardly intermediate adjacent openings is greatly restricted for, regardless of the fact that intermediate walled openings are provided for load bearing purposes, the entire pallet 12 will act as a unit to resist such deflection or deformation across the entire transverse dimensions thereof.

As shown upper wall 14 has a configuration thereon to simultaneously captively support a pair of members thereon having a cylindrical periphery. Accordingly, upper wall 14 is divided at the longitudinal midpoint thereof into a pair of identical upper wall sections 44. Each section 44 includes: a central generally planar circular portion 46 having an upwardly exposed surface 48; an annular portion 50 radially adjacent portion 46, coaxial therewith and having the upwardly exposed surface 52 thereof generally parallel to surface 48 and spaced downwardly therefrom; and a generally annular portion 54 radially adjacent portion 50, coaxial therewith and having the upwardly exposed surface 56 thereof generally parallel to surfaces 48 and 52 and spaced upwardly from surface 52 and downwardly from surface 48. The upwardly exposed surface 58 of section 44 outwardly from portion 54 is generally planar and lies in a plane which contains surface 48. Surfaces 48, 52 and 56 are formed with a plurality of upwardly open radially extending grooves 60 therein thereby giving upper wall sections 44 a visual sunburst effect. The grooves 60 aid in stiffening the upper wall 14 and also in distributing the loading to the webs and sidewall sections.

With a construction of upper wall 14 such as described hereinabove it is to be noted that a plurality of differing diameter annular peripheral work pieces, such as tractor rims, can be captively carried thereon; for example the annular periphery of the rims can have a diameter anywhere between the range of the outer diameter of surface 48 to the outer diameter of surface 56 and be captively retained with respect to any substantial transverse movement of the lower end of the rim with respect to the upper wall 14. The vertically intermediate location of surface 56 with respect to surfaces 52 and 48 is provided to insure minimum transverse movement between the rim and upper wall 14.

The pallet 12 of the present invention has capabilities of supporting rather heavy loads thereon without major deflection thereof because of the provision of the walled openings 34–40; the provisions of stiffening struts for walled openings 36–40; the provision of grooves 60; and the fact that load bearing support portions 32 of sidewall portions 20 extend inwardly to be in the more immediate vicinity of direct loading. Thus, when a rim edge is received on surface 52 of pallet 12 the rim edge is directly supported by the following sections of the walled portions lying directly or substantially directly beneath the rim; and walled openings 36, end side wall portion 22, load bearing support portion 32 of sidewall portion 20, side wall openings 38, and sidewall openings 40. Obviously by such an arrangement which provides at least nine points of direct support for the deflection of upper wall 14 caused by transference of non-directly supported loading to the sidewall 18 is substantially reduced.

It is to be noted that by necessity of providing maxium pallet utilization with minimum space requirements the annular portion 54 is not continuous but is interrupted by the dimensional controls of the pallet 12. In other words a rim having a periphery equal to the outer diameter of portion 54 would not engage upper wall 14 along the entire length thereof. Because of the sidewall and webbed configuration of pallet 12, this cantilevering of certain portions of the rim beyond the periphery of pallet 12 will not effect the support of the rim.

The lower wall is additionally divided at the longitudinal midpoint thereof into a pair of identical wall sections 44′. Each section 44′ can be of any suitable configuration and as shown comprises: a central generally planar circular portion 62 having a downwardly exposed surface 64; and a generally annular portion 66 radially adjacent portion 62, coaxial therewith and having a downwardly exposed structure 68 thereof generally parallel to surface 64 and spaced upwardly therefrom. The upwardly exposed surface 70 of section 44′ outwardly from portion 66 is generally planar and lies in a plane which contains surface 64. Similar to section 44 downwardly open radially extending grooves 60′ extend across surfaces 64 and 68.

The supporting cooperation of sections 44′ with respect to annular section such as a tractor rim is identical to that described for section 44 hereinbefore with the primary distinction therebetween being that section 44′ is more limited than section 44 as to captive retention because of the less involved configuration thereof. It is to be noted that if desired section 44′ can be made identical to section 44 or even more involved. Furthermore, the lower wall 16 can be used as the upper wall as conditions dictate. The particular embodiment illustrated is specifically utilized to support tractor rims which are either frusto conical in shape or comprise an elongated cylinder having a radially outwardly extending annular flange at the lower end thereof. With such a specific utilization the lower end of a pair of such rims are captively received by the upper wall 14 of pallet 12 adjacent thereto and the upper reduced diameter end of the pair of rims is captively received by the lower wall 16 of another pallet 12 adjacent thereto. Furthermore, an interlocking arrangement of a stack of rims can be accomplished by staggering the vertically spaced pallets 12.

It is to be noted that various modifications to the preferred embodiment discussed hereinabove can be made by one skilled in the art without departing from the invention herein, for example: only single sections 44 and 44′ may be provided or a plurality of sections other than two; the stiffening struts 42 need not necessarily be intermediate the upper and lower walls 14 and 16, respectively; a variety of surface configurations may be provided; provisions can be made for supporting polygonal articles rather than or in addition to annular or circular articles; the walled openings may be repositioned as necessary; the load bearing support portions of the sidewall may be positioned differently; and the like. Accordingly, the scope of the invention is to be interpreted only in accordance with the scope of the claims set forth hereinafter.

What is claimed is:

1. A reversible pallet formed for resinlike material comprising: a first wall adapted to receive a load thereon; a second wall adapted to receive a load thereon, vertically spaced from said first wall and extending in a plane generally parallel thereto; a substantially vertical wall extending substantially continuously between said first and second walls adjacent the respective outer peripheries thereof; at least one elongated vertically aligned opening in said first and second wall intermediate said outer peripheries thereof; an integrally formed substantially vertical load transfer wall extending continuously between said first and second walls adjacent the peripheries of each of said openings; stiffening means extending transversely between the longitudinal sides of at least some of said load transfer walls in a direction substantially normal to the longitudinal extent thereof; and said stiffening means for said at least some of said load transfer walls comprising a plurality of struts integrally formed with and longitudinally spaced along the longitudinal extent of the sides of the respective load transfer wall and located intermediate the upper and lower sides of said respective load transfer wall.

2. A pallet as specified in claim 1 including a plurality of sets of vertically aligned openings in said first and second walls.

3. A pallet as specified in claim 1 wherein said first wall has a grooved configuration to captively receive such a load thereon and said vertical wall and said load transfer walls provide at least five areas of substantially direct load transfer from said grooved configuration to said second wall.

* * * * *